US011221134B1

(12) United States Patent
Zhang

(10) Patent No.: US 11,221,134 B1
(45) Date of Patent: Jan. 11, 2022

(54) WALL LAMP WITH LIGHTING EFFECT RESEMBLING PEACOCK FEATHER SPREADING

(71) Applicant: GEMMY INDUSTRIES CORPORATION, Coppell, TX (US)

(72) Inventor: Cheng-Chun Zhang, Shenzhen (CN)

(73) Assignee: GEMMY INDUSTRIES CORPORATION, Coppell, TX (US)

( * ) Notice: Subject to any disclaimer, the term of this patent is extended or adjusted under 35 U.S.C. 154(b) by 0 days.

(21) Appl. No.: 16/991,622

(22) Filed: Aug. 12, 2020

(51) Int. Cl.

| | |
|---|---|
| ***F21V 14/02*** | (2006.01) |
| ***F21V 33/00*** | (2006.01) |
| *F21W 121/00* | (2006.01) |
| *F21V 21/08* | (2006.01) |
| *F21V 17/12* | (2006.01) |
| *F21Y 115/10* | (2016.01) |

(52) U.S. Cl.
CPC ..... *F21V 33/008* (2013.01); *F21V 17/12* (2013.01); *F21V 21/08* (2013.01); *F21W 2121/00* (2013.01); *F21Y 2115/10* (2016.08)

(58) Field of Classification Search
None
See application file for complete search history.

(56) References Cited

U.S. PATENT DOCUMENTS

2017/0219176 A1* 8/2017 Chang ..... F21V 15/01
2021/0156542 A1* 5/2021 Morand ..... F21V 19/003

* cited by examiner

*Primary Examiner* — Elmito Breval
(74) *Attorney, Agent, or Firm* — Birch, Stewart, Kolasch & Birch, LLP

(57) ABSTRACT

A wall lamp has a lamp housing having multiple decorative holes, a front decorative plate, an LED lighting assembly, and a rotating driver. The LED lighting assembly is disposed in the lamp housing and has multiple LED components. The rotating driver is mounted in the lamp housing and is connected to the LED lighting assembly. The LED lighting assembly driven by the rotating driver is rotated to change projecting positions of the LED components relative to the decorative holes of the lamp housing for generating a dynamic lighting effect that resembles peacock feather spreading and increasing dynamic variations of a decorative effect of the wall lamp.

12 Claims, 9 Drawing Sheets

WALL LAMP WITH LIGHTING EFFECT RESEMBLING PEACOCK FEATHER SPREADING

BACKGROUND OF THE INVENTION

1. Field of the Invention

The present invention relates to a wall lamp, and more particularly to a wall lamp with lighting effect that resembles peacock feather spreading.

2. Description of Related Art

Wall lamps provide lighting effect, some of which further provide decorative lighting effect. For a conventional wall lamp with lighting effect that resembles peacock feather spreading, multiple decorative holes are formed through a housing wall of a lamp housing of the conventional wall lamp. An LED lighting assembly is mounted in the lamp housing. When the conventional wall lamp is hung on a surface of a wall, light emitted by the LED lighting assembly passes through the decorative holes on the housing wall and projects on the surface of the wall to form an output lighting pattern for generating lighting effect that resembles peacock feather spreading.

In use, the light emitted by the LED lighting assembly is fixed in type. When the light passes through the decorative holes on the housing wall, the output lighting pattern is fixed, and the lighting effect resembling peacock feather spreading is monotonous. The output lighting pattern lacks dynamic variations. Therefore, the decorative effect of the conventional wall lamp with lighting effect resembling peacock feather spreading is not good.

To overcome the shortcomings, the present invention provides a wall lamp with lighting effect resembling peacock feather spreading to mitigate or obviate the aforementioned problems.

SUMMARY OF THE INVENTION

The objective of the invention is to provide a wall lamp with lighting effect resembling peacock feather spreading to increase dynamic variations and the decorative effect.

The wall lamp has a lamp housing, a front decorative plate, a light-emitting diode (LED) lighting assembly, and a rotating driver. The lamp housing has a front side, a housing wall, and multiple decorative holes. The multiple decorative holes are formed through the housing wall of the lamp housing and are patterned. The front decorative plate is mounted on the front side of the lamp housing. The LED lighting assembly is disposed in the lamp housing and has a circuit board and multiple LED components. The circuit board is disposed in the lamp housing. The multiple LED components are mounted on the circuit board. The rotating driver is mounted in the lamp housing and is connected to the LED lighting assembly. The rotating driver drives the LED lighting assembly to rotate for changing projecting positions of the LED components relative to the decorative holes of the lamp housing.

Furthermore, the multiple decorative holes are formed through a top section of the housing wall of the lamp housing, and the multiple LED components are monochromatic LED components with the same color light or different color lights.

Furthermore, the multiple decorative holes are formed through a top section of the housing wall of the lamp housing, and the LED components generate color light changes.

Furthermore, the rotating driver has a power panel, a fixing base, a motor, a fixing plate, and an electric connecting assembly. The power panel is mounted in the lamp housing. The fixing base is mounted on the power panel. The motor is mounted on the fixing base and has a shaft. The shaft is mounted on the motor, extends through the power panel and the fixing base, and has a top end. The fixing plate is mounted around the top end of the shaft. The LED lighting assembly is mounted on the fixing plate, and the motor drives the LED lighting assembly to rotate by the shaft. The electric connecting assembly is mounted between the circuit board of the LED lighting assembly and the power panel to form an electric connection.

Furthermore, a circuit of the circuit board of the LED lighting assembly has a positive contact and a negative contact. A circuit of the power panel has a positive terminal and a negative terminal The fixing base is made of insulating materials and has two positioning rods. The shaft of the motor is a conductive element. The electric connecting assembly has a positive torsional spring, a negative torsional spring, and an electric conductive sleeve. The positive torsional spring and the negative torsional spring are conductive elements and are respectively mounted around the two positioning rods of the fixing base. An end of the positive torsional spring is electrically connected to the positive terminal of the power panel by an electrode wiring. An end of the negative torsional spring is electrically connected to the negative terminal of the power panel by another electrode wiring. Another end of the negative torsional spring contacts the shaft and is electrically connected to the negative contact of the circuit board of the LED lighting assembly by the shaft. The electric conductive sleeve is mounted around the shaft and isolated from the shaft. Another end of the positive torsional spring electrically contacts the electric conductive sleeve and is electrically connected to the positive contact of the circuit board of the LED lighting assembly by the electric conductive sleeve.

Furthermore, the rotating driver has an electric conductive sheet and an electric conductive ring. The electric conductive sheet and the electric conductive ring are mounted around the shaft, and the electric conductive sheet is located above the electric conductive ring. The shaft is insulatedly inserted through and fixed on the circuit board of the LED lighting assembly. The top end of the shaft extends out of a top surface of the circuit board. The shaft is electrically connected to the negative contact of the circuit board of the LED lighting assembly by the electric conductive sheet, and the shaft electrically contacts the negative torsional spring by the electric conductive ring.

Furthermore, the rotating driver has a power converter. The power converter is disposed in the lamp housing and is electrically connected to the power panel by a wire.

The LED lighting assembly is driven by the rotating driver for rotating relative to the lamp housing. A position of each one of the multiple LED components relative to the multiple decorative holes of the lamp housing is changed continuously for generating a dynamic lighting effect that resembles peacock feather spreading and improving dynamic variations of a decorative effect of the wall lamp.

Moreover, the LED lighting assembly replaces the LED components with different color lights, or the LED lighting assembly is controlled to generate color light changes to obtain the lighting effect with different color lights. In addition, the wall lamp replaces the lamp housing having the decorative holes with different patterns to obtain the lighting effect that resembles peacock feather spreading with different patterns.

Furthermore, the electric connecting assembly is electrically connected between the circuit board of the LED lighting assembly and the power panel and has the positive torsional spring, a negative torsional spring, and the electric conductive sleeve. The positive torsional spring and the negative torsional spring are respectively mounted around the two positioning rods of the fixing base. One end of the positive torsional spring is electrically connected to the positive terminal of the power panel. One end of the negative torsional spring is electrically connected to the negative terminal of the power panel. Another end of the negative torsional spring electrically contacts the shaft and is electrically connected to the negative contact of the LED lighting assembly by the shaft. The electric conductive sleeve is mounted around the shaft and isolated from the shaft. Another end of the positive torsional spring electrically contacts the electric conductive sleeve and is electrically connected to the positive contact of the LED lighting assembly by the electric conductive sleeve. When the LED lighting assembly driven by the motor is rotated, the positive torsional spring and the negative torsional spring have elasticity and respectively and electrically contact the electric conductive sleeve and the shaft to maintain connection of a current loop. Therefore, the LED components in the wall lamp can keep lighting, and twisting problem can be avoided effectively.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
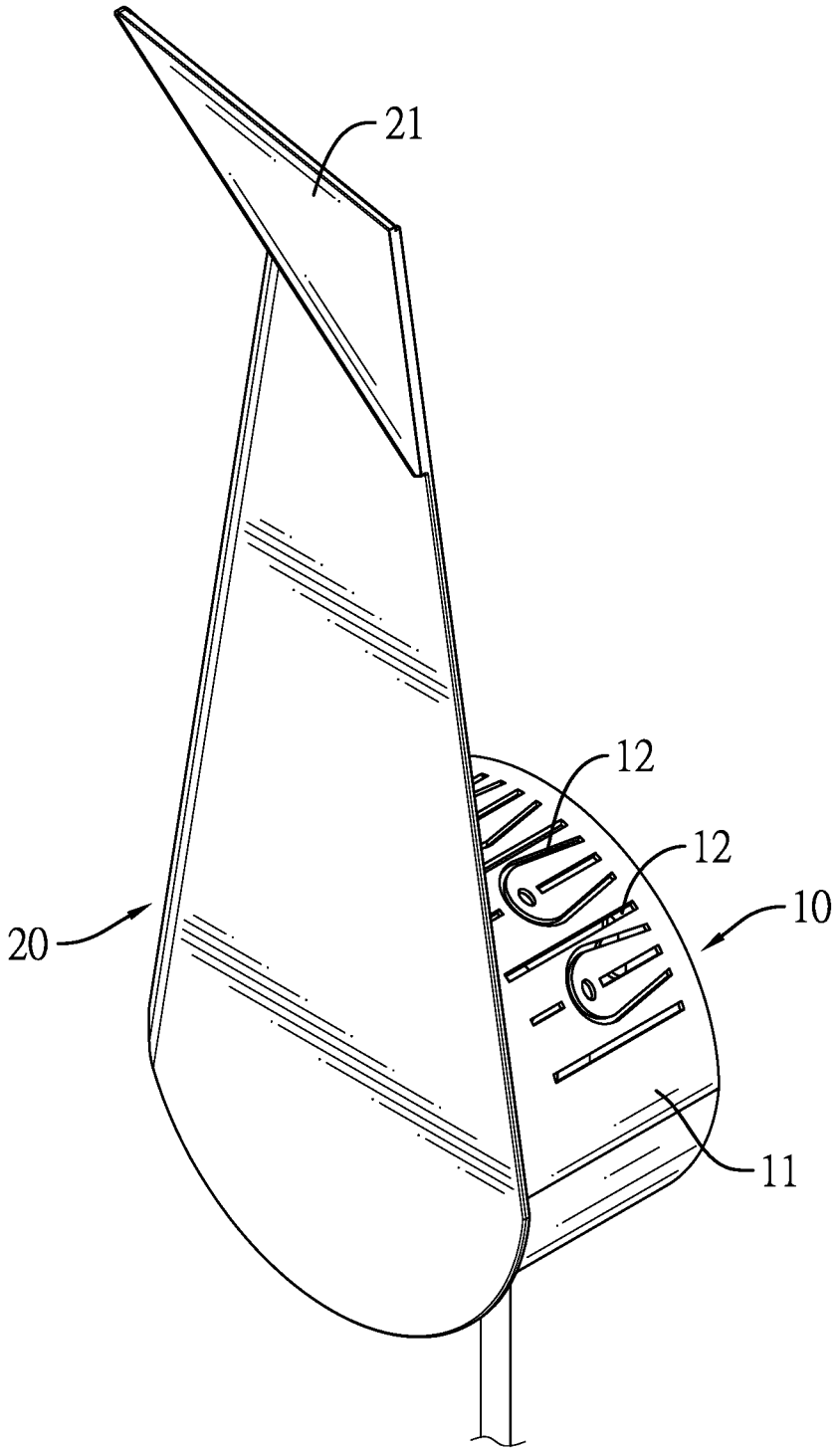
FIG. 1 is a perspective view of a wall lamp with lighting effect resembling peacock feather spreading in accordance with the present invention.
Figure 2:
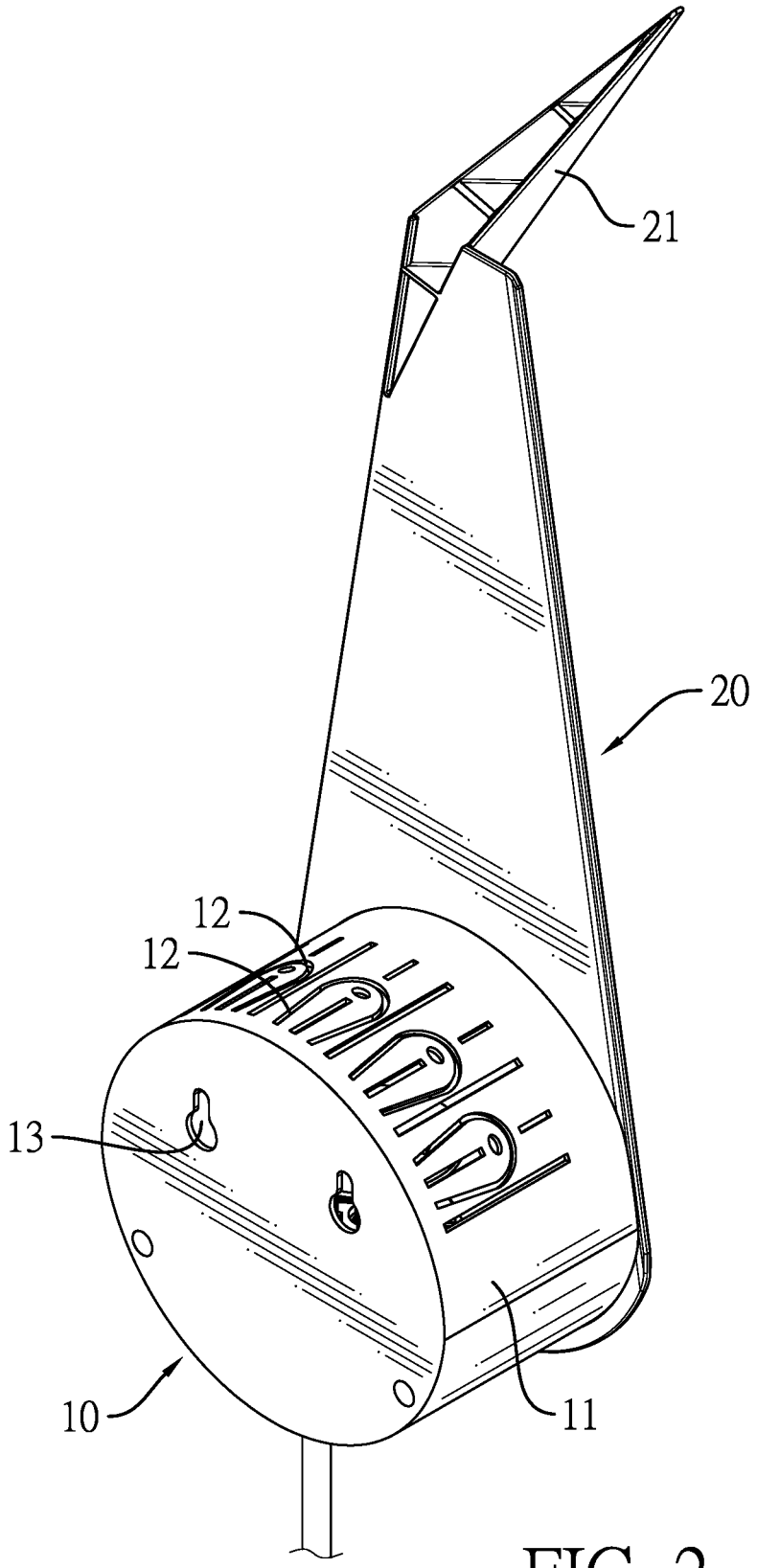
FIG. 2 is another perspective view of the wall lamp in FIG. 1.
Figure 3:
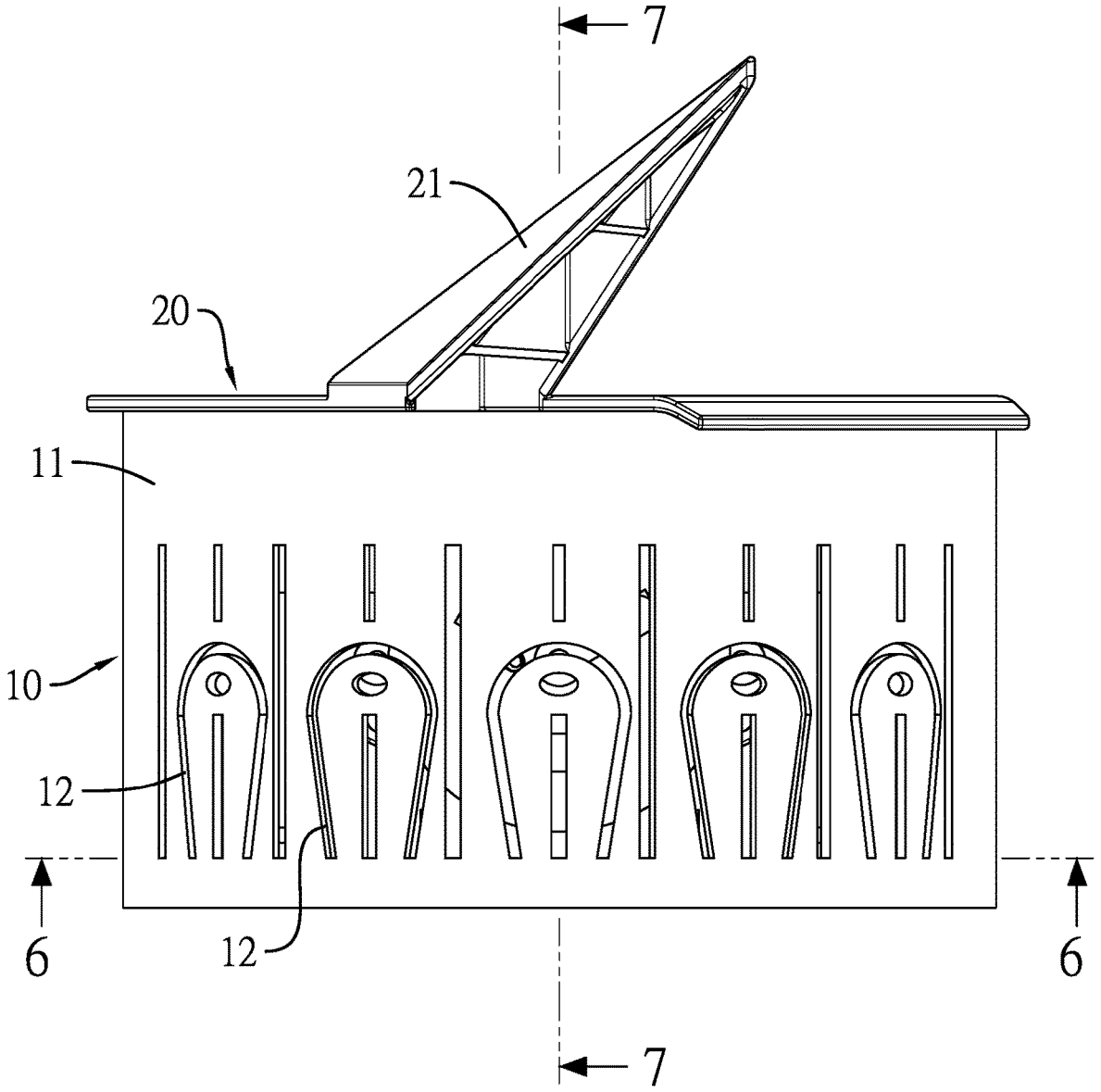
FIG. 3 is a top view of the wall lamp in FIGS. 1 and 2.
Figure 4:
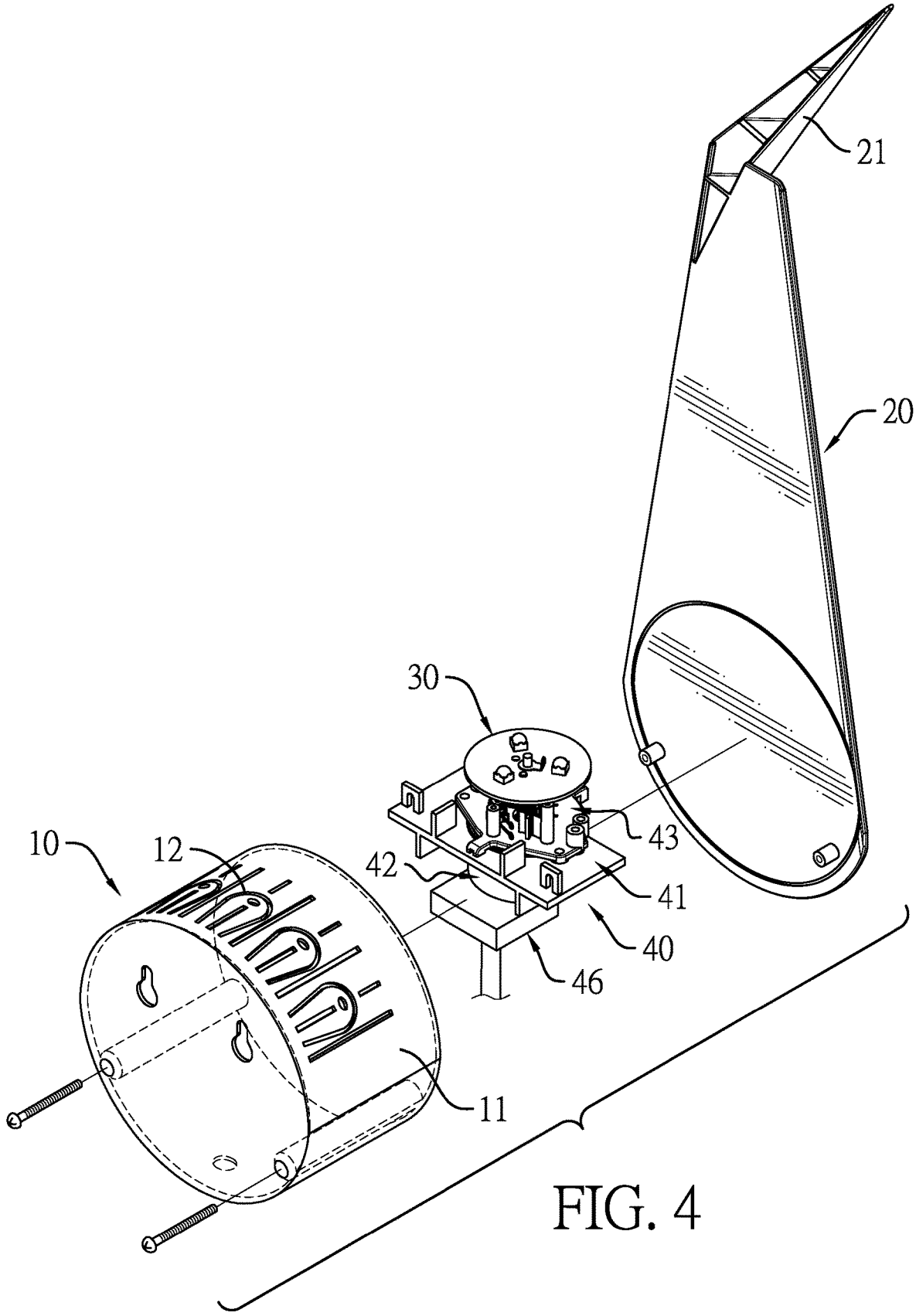
FIG. 4 is an exploded perspective view of the wall lamp in FIG. 2.

With reference to FIGS. 1 to 4, a wall lamp with lighting effect resembling peacock feather spreading in accordance with the present invention comprises a lamp housing 10, a front decorative plate 20, a light-emitting diode (LED) lighting assembly 30, and a rotating driver 40.

Figure 6:
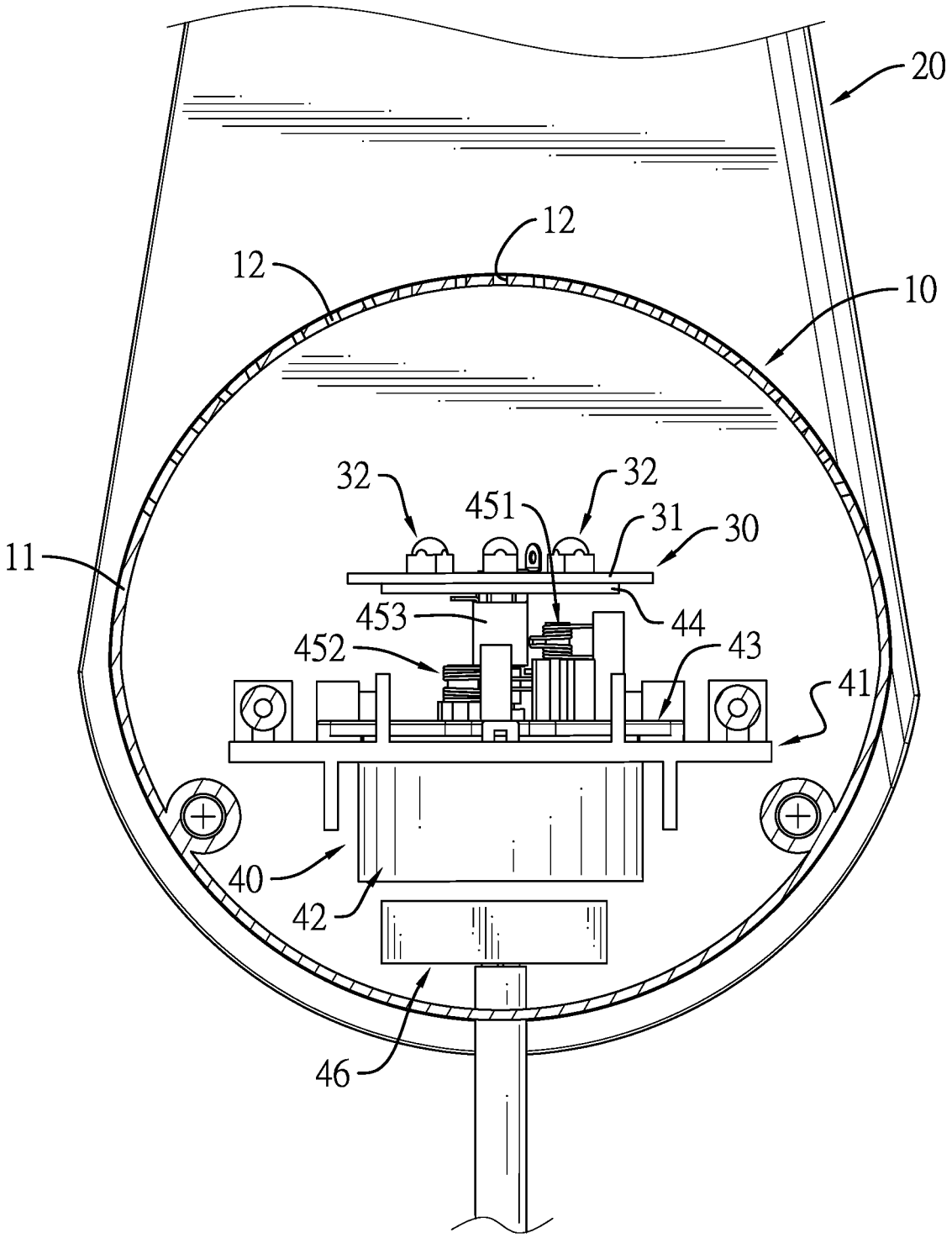
FIG. 6 is a cross sectional side view of the wall lamp along line 6-6 in FIG. 3.
Figure 7:
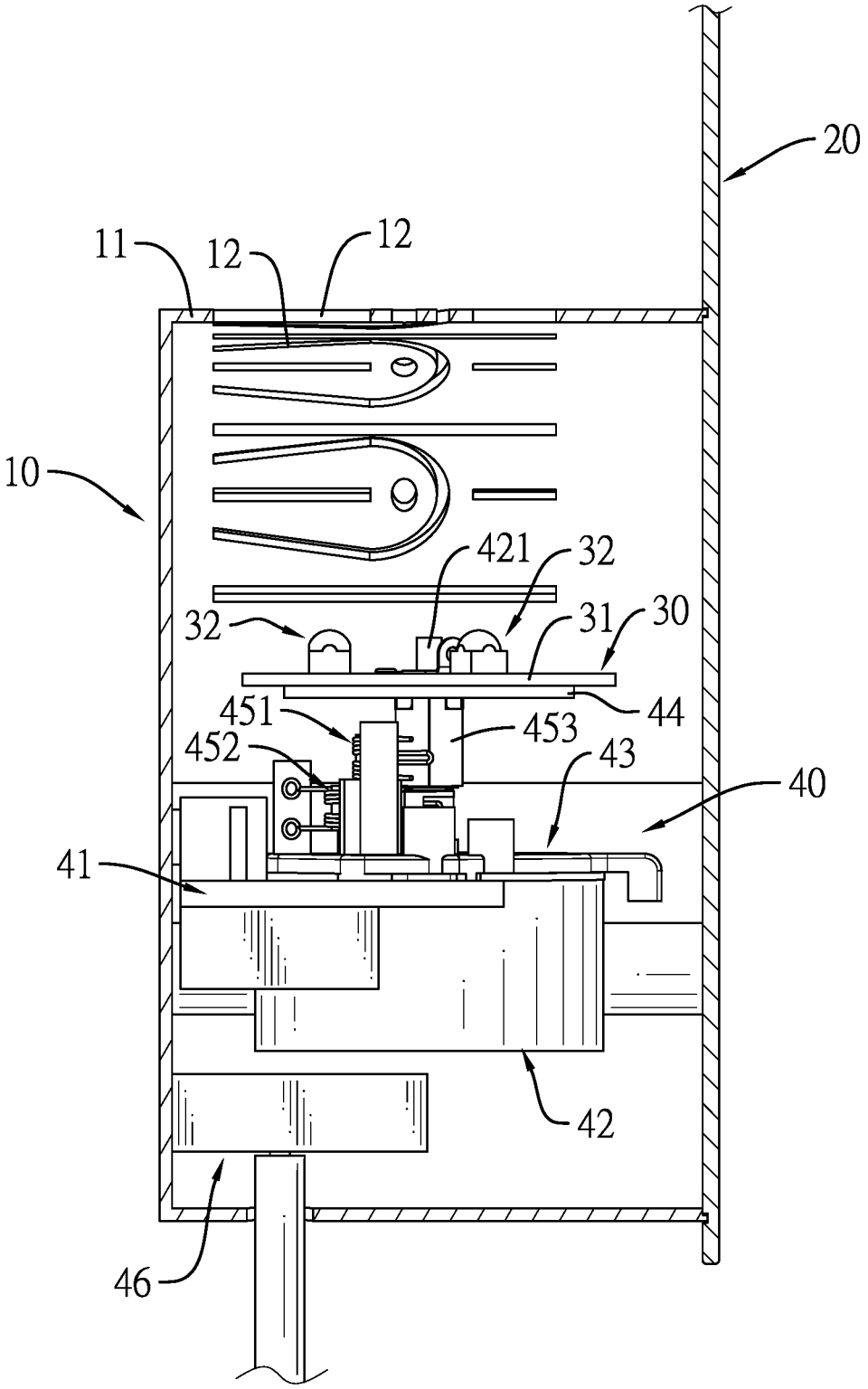
FIG. 7 is a cross sectional side view of the wall lamp along line 7-7 in FIG. 3.

With reference to FIGS. 1 to 4, 6, and 7, the lamp housing 10 has a front side, a chamber, an opening, a housing wall 11, and multiple decorative holes 12. The chamber is formed in the lamp housing 10. The opening is formed on the front side of the lamp housing 10 and communicates with the chamber. The housing wall 11 surrounds the chamber. The multiple decorative holes 12 are formed through the housing wall 11 of the lamp housing 10, communicate with the chamber of the lamp housing 10, and are patterned. The multiple decorative holes 12 are formed through a top section of the housing wall 11. Depending on product demands, the wall lamp can set the decorative holes 12 with different patterned shapes for generating lighting effects with different patterns. Furthermore, the lamp housing 10 has multiple hanging holes 13 formed through a back of the lamp housing 10. The lamp housing 10 can be hung on a surface of a wall by the hanging holes 13.

With reference to FIGS. 1 to 4, 6, and 7, the front decorative plate 20 is mounted on the front side of the lamp housing 10 and covers the opening of the lamp housing 10. The front decorative plate 20 is mounted on the lamp housing 10 by screws, engages with the lamp housing 10, or is bonded with the lamp housing 10. The front decorative plate 20 can be formed in a peacock-like shape. A needle-mouth protrusion 21 is formed on a top section of the front decorative plate 20 and protrudes forwardly.

Figure 5:
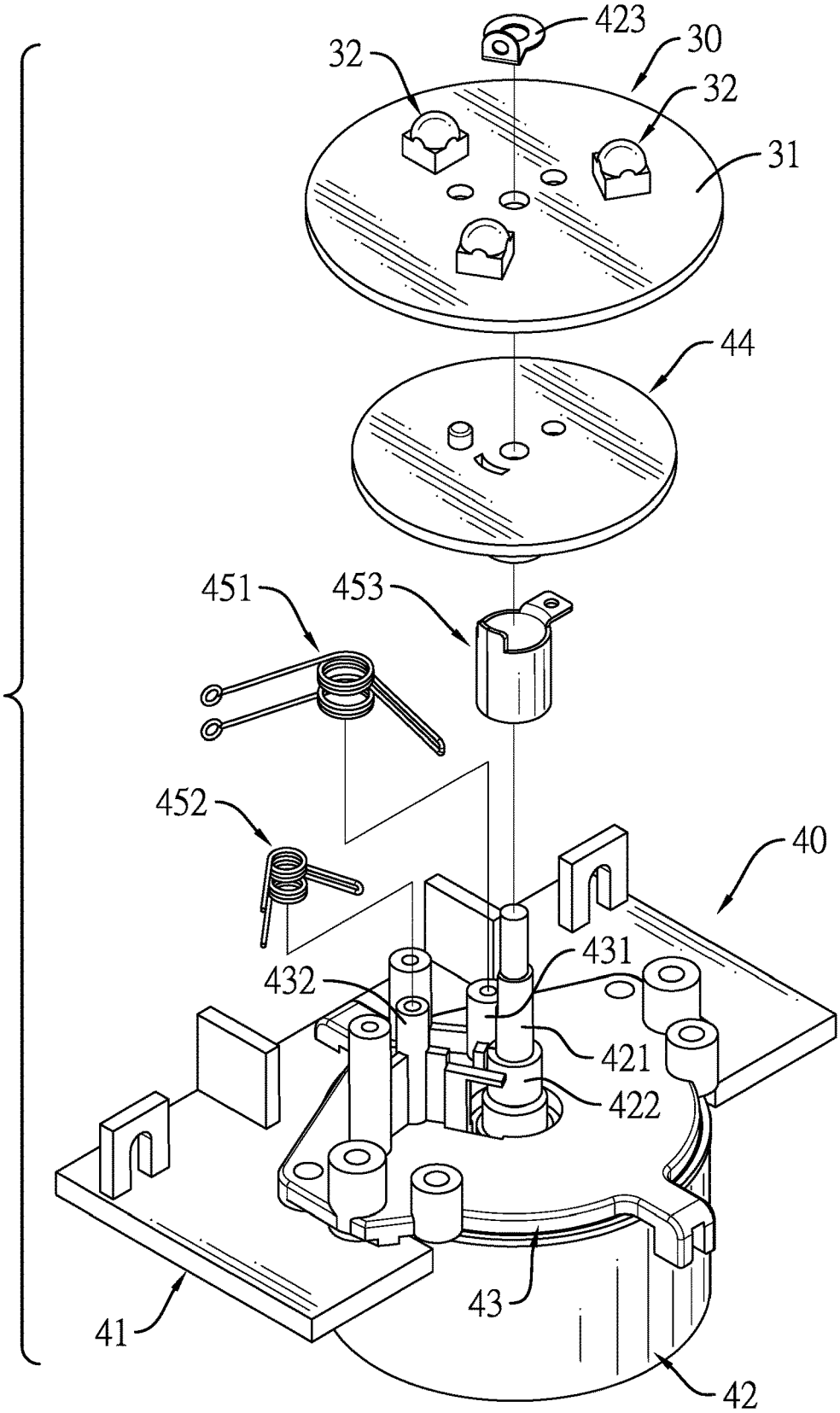
FIG. 5 is another exploded perspective view of the wall lamp in FIG. 4 showing an LED lighting assembly and a rotating driver.

With reference to FIGS. 4 to 7, the LED lighting assembly 30 is disposed in the lamp housing 10 and has a circuit board 31 and multiple LED components 32. The circuit board 31 is disposed in the lamp housing 10. The multiple LED components 32 are mounted on the circuit board 31. The LED lighting assembly 30 can be driven to rotate for changing projecting positions of the LED components 32 relative to the decorative holes 12 of the lamp housing 10. The circuit board 31 has a circuit. The multiple LED components 32 are electrically connected to the circuit of the circuit board 31 and can be controlled to light. Furthermore, the multiple LED components 32 include, but not limited to, three LED components 32. The multiple LED components 32 are monochromatic LED components with the same color light or different color lights. Moreover, the LED components 32 generate color light changes.

With reference to FIGS. 4 to 7, the rotating driver 40 is mounted in the chamber of the lamp housing 10, is connected to the LED lighting assembly 30, and drives the LED lighting assembly 30 to rotate. The rotating driver 40 has a power panel 41, a fixing base 43, a motor 42, a fixing plate 44, and an electric connecting assembly 45. The power panel 41 is mounted in the lamp housing 10. The fixing base 43 is mounted on the power panel 41. The motor 42 is mounted on the fixing base 43 and has a shaft 421. The shaft 421 is mounted on the motor 42, extends through the power panel 41 and the fixing base 43, and has a top end. The fixing plate 44 is mounted around the top end of the shaft 421. The LED lighting assembly 30 is mounted on the fixing plate 44, and the motor 42 drives the LED lighting assembly 30 to rotate by the shaft 421. The electric connecting assembly 45 is mounted between the circuit board 31 of the LED lighting assembly 31 and the power panel 41 to form an electric connection. The power panel 41 of the rotating driver 40 can be connected to an external direct current generator or an electric wire for supplying electricity to the LED lighting assembly 30 and the motor 42. Moreover, the rotating driver 40 has a power converter 46. The power converter 46 is disposed in the chamber of the lamp housing and is electrically connected to the power panel 41 by a wire. The power panel 41 is electrically connected to an external alternating current generator by the power converter 46. The power converter 46 can convert an alternating current to a direct current to light the LED lighting assembly 30 and drive the motor 42.

With reference to FIGS. 4 to 7, the circuit of the circuit board 31 of the LED lighting assembly 30 has a positive contact and a negative contact. A circuit of the power panel 41 has a positive terminal and a negative terminal. The fixing base 43 is made of insulating materials and has two positioning rods 431, 432. The electric connecting assembly 45 has a positive torsional spring 451, a negative torsional spring 452, and an electric conductive sleeve 453. The positive torsional spring 451 and the negative torsional spring 452 have electric conductivity and elasticity, and are respectively mounted around the two positioning rods 431, 432 of the fixing base 43. An end of the positive torsional spring 451 is electrically connected to the positive terminal of the power panel 41 by an electrode wiring. An end of the negative torsional spring 452 is electrically connected to the negative terminal of the power panel 41 by another electrode wiring, and another end of the negative torsional spring 452 contacts the shaft 421 and is electrically connected to the negative contact of the circuit board 31 of the LED lighting assembly 30 by the shaft 421. The electric conductive sleeve 453 is mounted around the shaft 421 and isolated from the shaft 421. Another end of the positive torsional spring 451 electrically contacts the electric conductive sleeve 453 and is electrically connected to the positive contact of the circuit board 31 of the LED lighting assembly 30 by the electric conductive sleeve 453 to form a current loop. When the LED lighting assembly 30 driven by the motor 42 is rotated, the electric connecting assembly 45 is electrically connected to the LED lighting assembly 30 and the power panel 41 by the positive torsional spring 451 and the negative torsional spring 452 respectively to avoid twisting.

With reference to FIGS. 4 to 7, the shaft 421 is insulatedly inserted through and fixed on the circuit board 31 of the LED lighting assembly 30. The rotating driver 40 has an electric conductive sheet 423 and an electric conductive ring 422. The electric conductive sheet 423 and the electric conductive ring 422 are mounted around the shaft 421, and the electric conductive sheet 423 is located above the electric conductive ring 422. The electric conductive ring 422 provides an electrical contacting portion for the negative torsional spring 452 to indirectly and electrically contact the shaft 421. The top end of the shaft 421 extends out of a top surface of the circuit board 31. The shaft 421 is electrically connected to the negative contact of the circuit board 31 of the LED lighting assembly 30 by the electric conductive sheet 423, and the shaft 421 electrically contacts the negative torsional spring 452 by the electric conductive ring 422.

Figure 8:
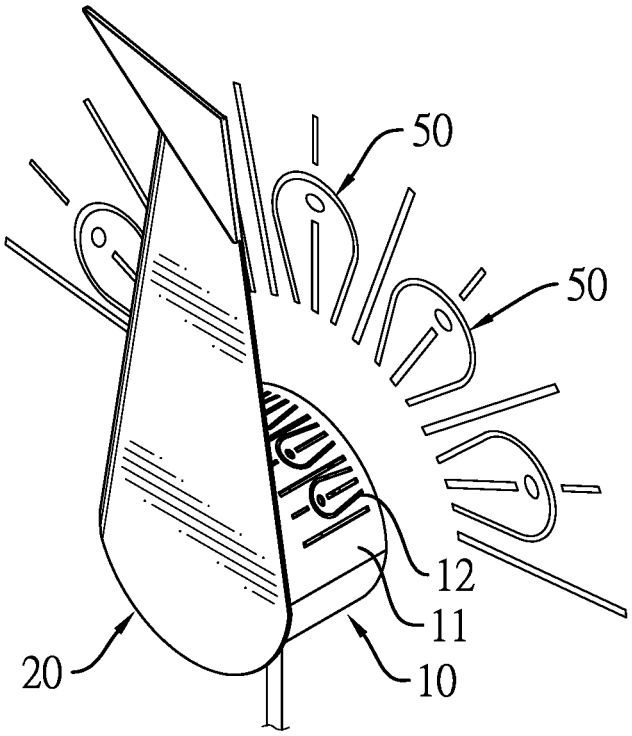
FIG. 8 is an operational perspective view of the warning light in FIG. 1.
Figure 9:
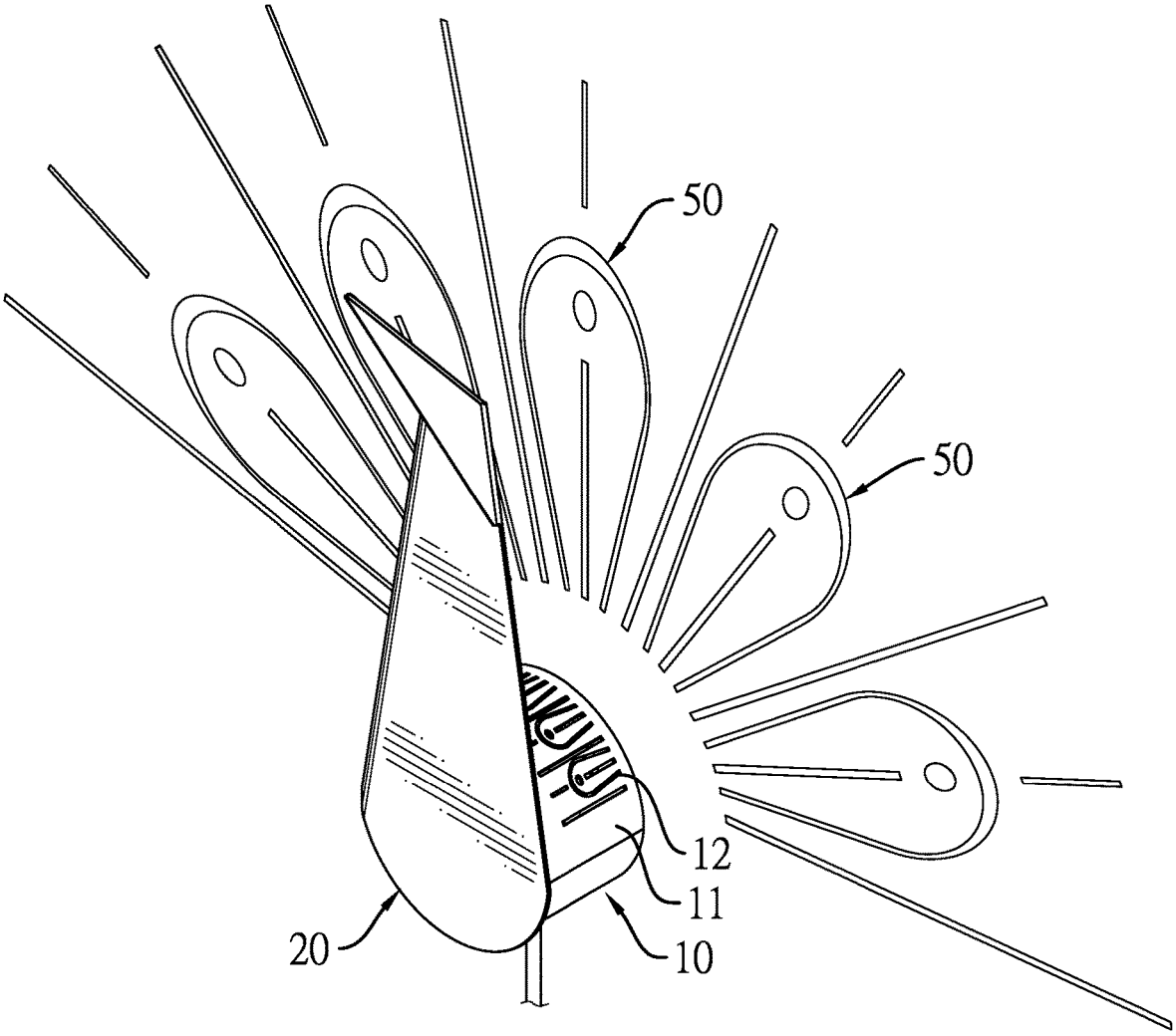
FIG. 9 is another operational perspective view of the warning light in FIG. 1.

With reference to FIGS. 6 to 9, the wall lamp is mounted on the surface of the wall and is connected to a power. Light emitted by the LED components 32 of the LED lighting assembly 30 passes through the decorative holes 12 of the lamp housing 10 and projects on the surface of the wall to form output lighting patterns 50. The output lighting patterns 50 are combined for generating the lighting effect resembling peacock feather spreading. Simultaneously, the rotating driver 40 drives the LED lighting assembly 30 to rotate relative to the lamp housing 10. A position of each one of the LED components 32 relative to the decorative holes 12 of the lamp housing 10 is changed continuously for generating dynamic peacock-like lighting effect.

In addition, the LED lighting assembly 30 replaces the LED components 32 with different color lights, or the LED lighting assembly 30 is controlled to generate color light changes to obtain the lighting effect with different color lights. In addition, the wall lamp replaces the lamp housing 10 having the decorative holes 12 with different patterns to obtain the lighting effect resembling peacock feather spreading with different patterns.

What is claimed is:

1. A wall lamp comprising:

a lamp housing having
- a front side;
- a housing wall; and
- multiple decorative holes formed through the housing wall of the lamp housing and being patterned;

a front decorative plate mounted on the front side of the lamp housing;

a light-emitting diode (LED) lighting assembly disposed in the lamp housing and having
- a circuit board disposed in the lamp housing, wherein a circuit of the circuit board of the LED lighting assembly has a positive contact and a negative contact; and
- multiple LED components mounted on the circuit board; and a rotating driver mounted in the lamp housing and connected to the LED lighting assembly, wherein the rotating driver drives the LED lighting assembly to rotate for changing projecting positions of the LED components relative to the decorative holes of the lamp housing the rotating driver having
- a power panel mounted in the lamp housing, wherein a circuit of the power panel has a positive terminal and a negative terminal;
- a fixing base mounted on the power panel, made of insulating materials, and having two positioning rods;
- a motor mounted on the fixing base and having
  - a shaft being a conductive element, mounted on the motor, extending through the power panel and the fixing base, and having a top end;
- a fixing plate mounted around the top end of the shaft, wherein the LED lighting assembly is mounted on the fixing plate, and the motor drives the LED lighting assembly to rotate by the shaft and
- an electric connecting assembly mounted between the circuit board of the LED lighting assembly and the power panel to form an electric connection, wherein the electric connecting assembly has a positive torsional spring, a negative torsional spring, and an electric conductive sleeve, the positive torsional spring and the negative torsional spring are conductive elements and are respectively mounted around the two positioning rods of the fixing base; an end of the positive torsional spring is electrically connected to the positive terminal of the power panel by an electrode wiring; an end of the negative torsional spring is electrically connected to the negative terminal of the power panel by another electrode wiring; another end of the negative torsional spring contacts the shaft and is electrically connected to the negative contact of the circuit board of the LED lighting assembly by the shaft the electric conductive sleeve is mounted around the shaft and isolated from the shaft another end of the positive torsional spring electrically contacts the electric conductive sleeve and is electrically connected to the positive contact of the circuit board of the LED lighting assembly by the electric conductive sleeve.

2. The wall lamp as claimed in claim 1, wherein the multiple decorative holes are formed through a top section of the housing wall of the lamp housing, and the multiple LED components are monochromatic LED components with the same color light.

3. The wall lamp as claimed in claim 2, wherein the rotating driver has an electric conductive sheet and an electric conductive ring, the electric conductive sheet and the electric conductive ring are mounted around the shaft, and the electric conductive sheet is located above the electric conductive ring; and the shaft is insulatedly inserted through and fixed on the circuit board of the LED lighting assembly, the top end of the shaft extends out of a top surface of the circuit board, the shaft is electrically connected to the negative contact of the circuit board of the LED lighting assembly by the electric conductive sheet, and the shaft electrically contacts the negative torsional spring by the electric conductive ring.

4. The wall lamp as claimed in claim 2, wherein the rotating driver has a power converter, and the power converter is disposed in the lamp housing and electrically connected to the power panel by a wire.

5. The wall lamp as claimed in claim 1, wherein the multiple decorative holes are formed through a top section of the housing wall of the lamp housing, and the multiple LED components are monochromatic LED components with different color lights.

6. The wall lamp as claimed in claim 5, wherein the rotating driver has an electric conductive sheet and an electric conductive ring, the electric conductive sheet and the electric conductive ring are mounted around the shaft, and the electric conductive sheet is located above the electric conductive ring; and the shaft is insulatedly inserted through and fixed on the circuit board of the LED lighting assembly, the top end of the shaft extends out of a top surface of the circuit board, the shaft is electrically connected to the negative contact of the circuit board of the LED lighting assembly by the electric conductive sheet, and the shaft electrically contacts the negative torsional spring by the electric conductive ring.

7. The wall lamp as claimed in claim 5, wherein the rotating driver has a power converter, and the power converter is disposed in the lamp housing and electrically connected to the power panel by a wire.

8. The wall lamp as claimed in claim 1, wherein the multiple decorative holes are formed through a top section of the housing wall of the lamp housing, and the LED components generate color light changes.

9. The wall lamp as claimed in claim 8, wherein the rotating driver has an electric conductive sheet and an electric conductive ring, the electric conductive sheet and the electric conductive ring are mounted around the shaft, and the electric conductive sheet is located above the electric conductive ring; and the shaft is insulatedly inserted through and fixed on the circuit board of the LED lighting assembly, the top end of the shaft extends out of a top surface of the circuit board, the shaft is electrically connected to the negative contact of the circuit board of the LED lighting assembly by the electric conductive sheet, and the shaft electrically contacts the negative torsional spring by the electric conductive ring.

10. The wall lamp as claimed in claim 8, wherein the rotating driver has a power converter, and the power converter is disposed in the lamp housing and electrically connected to the power panel by a wire.

11. The wall lamp as claimed in claim 1, wherein the rotating driver has an electric conductive sheet and an electric conductive ring, the electric conductive sheet and the electric conductive ring are mounted around the shaft, and the electric conductive sheet is located above the electric conductive ring; and the shaft is insulatedly inserted through and fixed on the circuit board of the LED lighting assembly, the top end of the shaft extends out of a top surface of the circuit board, the shaft is electrically connected to the negative contact of the circuit board of the LED lighting assembly by the electric conductive sheet, and the shaft electrically contacts the negative torsional spring by the electric conductive ring.

12. The wall lamp as claimed in claim 1, wherein the rotating driver has a power converter, and the power converter is disposed in the lamp housing and electrically connected to the power panel by a wire.

* * * * *